US005887599A

United States Patent [19]

Habibi

[11] Patent Number: 5,887,599

[45] **Date of Patent: *Mar. 30, 1999**

[54] ADJUSTABLE HAIR CURLER AND METHOD OF USE

[76] Inventor: Masood Habibi, Box 71104, Los Angeles, Calif. 90071

[ * ] Notice: The term of this patent shall not extend beyond the expiration date of Pat. No. 5,662,128.

[21] Appl. No.: 929,242

[22] Filed: Sep. 10, 1997

[51] Int. Cl.[6] ..... A45D 7/04

[52] U.S. Cl. ..... 132/205; 132/210; 132/247; 132/233

[58] Field of Search ..... 132/210, 203, 132/205, 247, 253, 245, 212, 222, 265, 248, 250, 223, 273, 211

[56] References Cited

U.S. PATENT DOCUMENTS

| | | | |
|---|---|---|---|
| 1,892,107 | 12/1932 | Jancke et al. | 132/229 |
| 1,894,431 | 1/1933 | Vaghelatos | 132/229 |
| 1,926,987 | 9/1933 | Durham et al. | 219/24 |
| 1,957,049 | 5/1934 | Lakenbach | 132/36.2 |
| 2,720,207 | 10/1955 | Burtnett | 132/245 |
| 3,232,300 | 2/1966 | Fisher | 132/245 |
| 3,523,542 | 8/1970 | Eisler | 132/33 |
| 3,590,829 | 7/1971 | Parisi | 132/43 |
| 3,871,388 | 3/1975 | Leoci | 132/9 |
| 4,022,225 | 5/1977 | Kauffman | 132/31 |
| 4,022,226 | 5/1977 | Muenstermann | 132/39 |
| 4,270,555 | 6/1981 | Punte | 132/40 |
| 4,456,020 | 6/1984 | van Deursen | 132/34 |
| 4,524,788 | 6/1985 | Pauldine | 132/42 |
| 4,584,462 | 4/1986 | Morrison | 219/222 |
| 4,714,820 | 12/1987 | Morrison et al. | 219/222 |
| 4,856,542 | 8/1989 | Hollenberg et al. | 132/265 |
| 4,911,186 | 3/1990 | Hayden | 132/246 |
| 5,000,200 | 3/1991 | Roberts | 132/245 |
| 5,024,244 | 6/1991 | Brown | 132/270 |
| 5,186,187 | 2/1993 | Roberts | 132/245 |
| 5,293,884 | 3/1994 | Chapman et al. | 132/273 |
| 5,294,777 | 3/1994 | Denhup | 219/225 |
| 5,411,040 | 5/1995 | Forrest | 132/211 |
| 5,662,128 | 9/1997 | Habibi | 132/210 |
| 5,694,954 | 12/1997 | Habibi | 132/211 |
| 5,715,846 | 2/1998 | Kim | 132/210 |

*Primary Examiner*—Gene Mancene
*Assistant Examiner*—Pedro Philogene
*Attorney, Agent, or Firm*—D'Alessandro & Ritchie

[57] ABSTRACT

The present invention is directed to a novel adjustable diameter hair curler which is extremely lightweight, portable, and suitable for travel. The novel adjustable curler includes a substrate of a flexible material such as a plastic or fabric or backing material which may optionally include a thin spring steel lamination for added resilience. The substrate has a first planar side and a second planar side opposite said first planar side. Attached to the first side of the substrate are an array of hook-type elements from a hook and loop-type fastening system such as VELCRO® brand hook and loop fasteners available from Velcro Industries of Manchester, N.H. The hook-type elements are generally arrayed over the majority of the first side. Strips of engaging materials are provided on each side of the substrate to secure the adjustable curler in a cylindrical form having a selected diameter. By rolling the substrate to form a cylinder so that a portion of the substrate overlaps another portion of the substrate, the engaging materials may interact to hold the cylinder's shape with relative ease and complete adjustability of cylinder diameter. Lock-in of the shape may be accomplished easily with a single hand. For storage, the curlers may be completely flattened for storage or transport in a very minimal volume.

12 Claims, 7 Drawing Sheets

ADJUSTABLE HAIR CURLER AND METHOD OF USE

BACKGROUND OF THE INVENTION

1. Field of the Invention

The present invention relates to hair curlers for curling and setting the shape of human hair. More particularly, the invention relates to a novel adjustable apparatus for curling hair to selected diameter curls. The apparatus may be stored and carried in a small volume.

2. The Background Art

Hair curlers are well known in the art. Such devices traditionally comprise a cylinder upon which hair is rolled or curled. Heat and/or hair spray or other hair products are often applied so that the hair takes on the shape of the curler and, when the curler is removed, the hair is still curled. It is often desirable to be able to adjust the diameter of a curler so that a small number of curlers may offer the capability of curling at a number of diameters. A number of adjustable diameter curlers are thus known in the art. U.S. Pat. No. 4,456,020 to van Deursen teaches an adjustable diameter curler. The van Deursen device comprises a pair of telescoping elongated tubes axially and rotatably movable relative to one another. A pair of nested larger diameter end caps is secured at each end of each tube with the roller generally resembling a spool. Each pair of end caps includes a first cap with spiralled cam slots radiating from its center and a second cap nested in the first with a plurality of corresponding or equal number of straight cam slots radiating from its center. The nesting caps are rotatable relative to each other and the caps at each end are connected together by a plurality of toothed elongated curler segments. Each segment has structure at each end cooperating with the cap slots such that by rotating the end caps in opposite directions the segments are radially cammed to change the curler roller diameter. Additional structure locks the cap rotation at any desired roller diameter.

U.S. Pat. No. 5,186,187 to Roberts teaches another adjustable diameter curler. Roberts' device provides for the use of a cylindrical tube rolled from a rectangular perforated sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired.

U.S. Pat. Nos. 5,020,552 and 4,856,542 to Hollenberg et al. teach a radially expandable hair curler comprising a generally cylindrical hollow body, a detachable holding strap stretching from one longitudinal end of the body to the other, and internal mechanical devices for expanding and contracting the curler body.

U.S. Pat. No. 4,270,555 to Punte teaches a hair curler that provides for a plurality of stages of hair curling with increasing wave lengths along the length of the hairs of the head. The hair curler may be used on short hair or very long hair. The multi-stages provide for a selectivity of lengths for short hair. The hair curler consists of a plurality of removably insertable curler components that nest one within the other in a manner similar to a telescoping mechanism. An elastic tie provides a means for securing the plurality of removably insertable components together and, at the same time, holds the hair in place on the curler. A port hole in one end provides a means for applying wave solution to the hair rolled on the interior of the roller, with communicating slots to permit the solution to seep through to the hair at the periphery of the spiraling rolls of hair.

U.S. Pat. No. 5,000,200 to Roberts provides for the use of a cylindrical tube rolled from a rectangular sheet of flexible material, the sheet having an outer edge which overlaps a portion of the tube. The tube has a pair of opposing transverse edges, each of which is engaged within a spiral groove formed in opposing end caps. The end caps are rotationally mounted on an elongated shaft, such that rotation of the caps causes advancement of the transverse edges within the spiral grooves, changing the diameter of the outer tube, as desired.

U.S. Pat. No. 3,232,300 to Fisher teaches an adjustable diameter hair curler formed of a sheet of soft plastic having an array of holes and a line of snap-type fasteners. The snaps mate with and penetrate a line of holes in the array to hold the sheet in the form of a cylinder. Diameter adjustment is accomplished by selecting another line of holes to apply the snaps to.

Non-adjustable fixed-diameter cylindrical hair curlers are known which include hook-type fasteners on the outer portion of the cylinder for engaging hair.

While the foregoing devices are fit for their intended purposes, there is room for improvement in portable, adjustable diameter hair curlers.

SUMMARY OF THE INVENTION

The present invention is directed to a novel adjustable diameter hair curler which is extremely lightweight, portable, and suitable for travel. The novel adjustable curler comprises a substrate of a flexible material such as a plastic, a spring steel, or a composite of one or more plastic and one or more spring steel laminations. The substrate has a first planar side for contacting the hair and a second planar side opposite said first planar side. Attached to a center strip of the first side of the substrate are an array of hook-type elements of a first type from a hook and loop-type fastening system. The center strip occupies a majority of the area of the first side. The hook-type elements of the first type are for engaging the hair and are generally arrayed over the bulk of the first side excepting one or more longitudinal strips along the length of the first side of the substrate. The longitudinal strips on the first side correspond to dissimilar longitudinal strips on the second side. For example, one strip may comprise hook-type fastener material; if so, its corresponding dissimilar strip would comprise loop-type fastener material. Strips on one side may be of similar or dissimilar materials. By rolling the substrate to form a cylinder so that a portion of the substrate overlaps another portion of the substrate, the hook and loop (or other) fasteners may interact to hold the cylinder's shape with relative ease and complete adjustability of cylinder diameter. Lock-in of the shape may be accomplished easily with a single hand. The curlers may be completely flattened for storage or transport in a very minimal volume.

According to another aspect of the invention, the hook-type fasteners of the longitudinal strips is of a second type having a hook density higher than that of the hook density of the hook-type fasteners of the first type occupying the center strip of the first side of the hair curler.

According to another aspect of the present invention, a receptacle and/or guide for a clip such as a bobby pin or hair clip is provided at one end of the substrate to aid in clipping or pinning hair to the curled substrate.

OBJECTS AND ADVANTAGES OF THE INVENTION

Accordingly, it is an object of the present invention to provide a novel hair curler.

It is a further object of the present invention to provide a novel hair curler which is completely adjustable in diameter, yet requires no moving parts.

Yet a further object of the present invention is to provide an adjustable diameter curler which may be manipulated by a single hand.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The use of hair curlers to curl hair for cosmetic purposes is well known in the art. Such prior art curlers offer a number of drawbacks. When fixed-diameter curlers are used, they are frequently voluminous to store or transport as a large number of curlers may be needed at any one time, and a complete set at each desired diameter may be required for full flexibility. Adjustable diameter curlers known in the art are often complex mechanisms which may be difficult to manipulate and which often do not store in a flat configuration so that storage in a small volume is possible. Such small volume storage is highly desirable for travel, or servicing customers away from the hair salon. The present invention resolves these drawbacks with elegant simplicity.

Figure 1A:
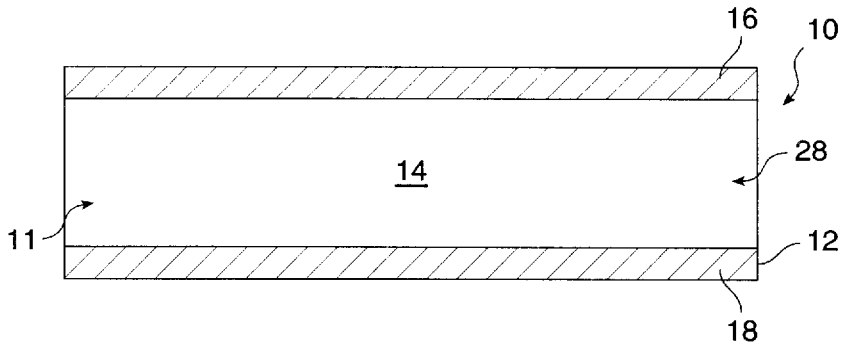
FIG. 1A is a top plan view of the adjustable curler according to a presently preferred embodiment of the present invention.
Figure 1B:
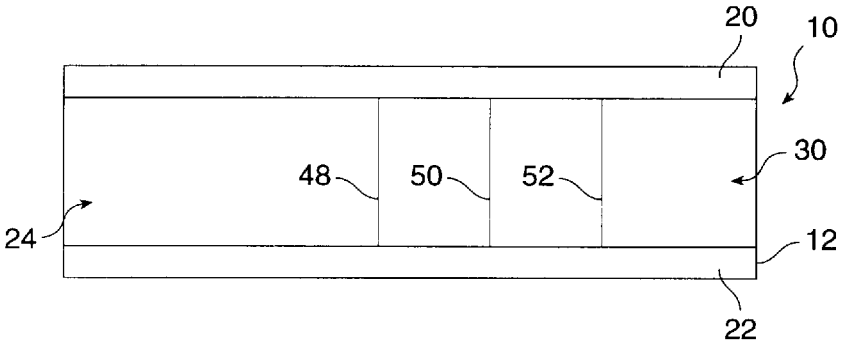
FIG. 1B is a bottom plan view of the adjustable curler according to a presently preferred embodiment of the present invention.
Figure 1C:
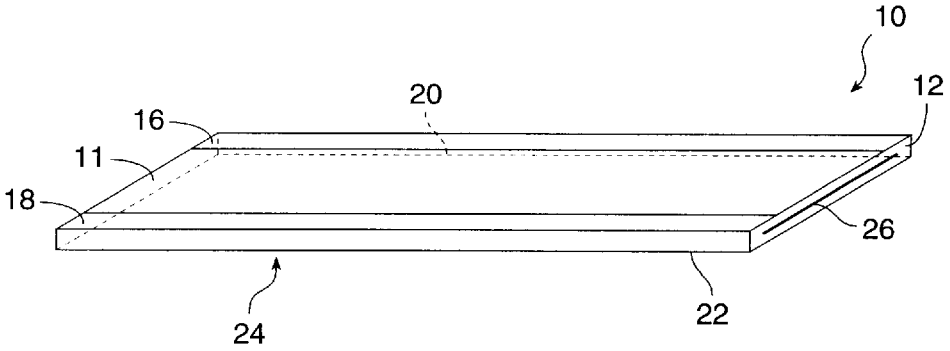
FIG. 1C is a perspective view of the adjustable curler according to a presently preferred embodiment of the present invention.

Turning now to FIGS. 1A, 1B and 1C, a presently preferred embodiment of the present invention is depicted. FIG. 1A depicts the first side 11 of a hair curler 10 and FIG. 1B depicts the second side 24 of the same hair curler 10. FIG. 1C is a perspective view of hair curler 10. Hair curler 10 comprises a flexible substrate 12 which may be rolled into the cylindrical shape of a curler. In a center strip 14 of the first side 11 of hair curler 10 is disposed an array of hook-type fasteners of a first type or hook density for engaging the hair. Strips 16 and 18 extend longitudinally along the length of first side 11 of hair curler 10. Strips 16 and 18 are used for adhering successive layers of hair curler 10 together when rolled so as to hold it in the shape of a cylinder. In order to accomplish this, respective mating strips 20 and 22 are also provided along the length of second side 24. Strip 16 engages strip 20 and strip 18 engages strip 22. The materials for strips 16, 18, 20 and 22 are preferably selected so that one of strip 16 and 20 is a hook-type fastener material while the other is a loop-type (or equivalent) material, and one of strip 18 and 22 is a hook-type fastener material while the other is a loop-type (or equivalent) material. Preferably the hook-type fastener material used in two of strips 16, 18, 20, 22 is of a second type having a higher hook density than the hook-type fastener material of the first type. In this way, when formed into a cylinder, successive layers of the cylinder will adhere to one another along the longitudinal strips.

Flexible substrate 12 is preferably formed of a soft flexible plastic material of thickness less than about 0.25 inches, width preferably about 4 inches and length preferably about 12 inches. Different sizes may be used as desired. A cloth fabric material may also be used. The exact constitution of the substrate is unimportant as long as it may serve as a base for the hook and loop fasteners and provide some rigidity when coiled as shown in FIGS. 4–8. In accordance with one presently preferred embodiment, flexible substrate 12 may include a flexible metal member 26, such as a thin flat plate of overall width less than the overall width of the hair curler and selected so as to provide resiliency and to help the hair curler attain and hold the desired cylindrical shape during and after repeated heating and cooling cycles. Presently preferred is a rust resistant spring steel having a thickness in the range of about 0.001" to about 0.025". Laminated structures may be used.

Figure 2:
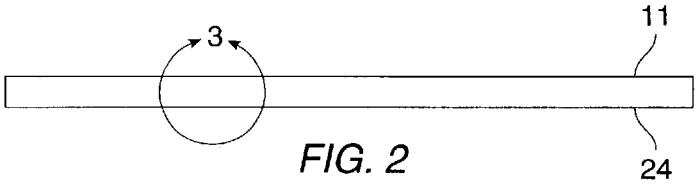
FIG. 2 is a side view of the adjustable curler according to a presently preferred embodiment of the present invention.
Figure 3:
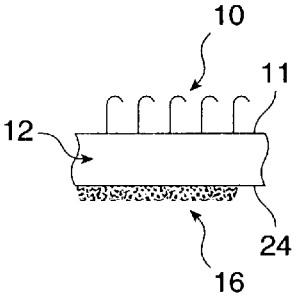
FIG. 3 is an enlarged view of the portion of FIG. 2 denoted with line 3 showing the hook and loop fastener system applied.

The substrate material should be washable and water resistant. FIGS. 1A, 1B, 1C, 2 and 3 show the basic configuration of this preferred embodiment. FIG. 2 is a side view, and FIG. 3 is an enlargement of a portion of FIG. 2 taken along line 3 and showing the hook and loop fasteners as applied.

In a preferred embodiment of the present invention, a hook-type fastener material such as #90083 VELCRO® having a hook density of approximately 250–350 hooks per square inch is adhered to first side 11 of hair curler 10 at center strip 28 as the hook-type fastener material of the first type. This is the portion of the hair curler which primarily engages the hair. Larger hooks, i.e., lower hook densities, may also be used. Smaller hooks (higher hook densities) are not preferred for this application because they tend to tangle the hair. Since the curlers may need to be washed from time to time, if a chemical adhesive is used, it should not be soluble in water. Hot melt glues, epoxies and similar permanent chemical adhesives may be used to adhere the hook-type fastener material to substrate 12.

Optionally, loop-type fastener material may be permanently adhered to second side 24 of substrate 12 at corresponding center strip 30. Such loop-type fastener material may engage the hook-type fasteners of first side center strip 14.

Hook and loop fastener strips should be adhered in a similar fashion as desired at strips 16, 18, 20 and 22.

There is no requirement that substrate 12 be rectangular, although it is a convenient shape. There is no requirement that the entirety of either first side 11 or second side 24 be covered with hook and/or loop-type fasteners. The majority of first side 11 should be covered with hook-type fasteners of the first type while a relatively small portion should be devoted to strips 16, 18. In a presently preferred embodiment, strips 16, 18 are formed of loop-type fastener material and strips 20, 22 on second side 24 are formed of hook-type fastener material of a second type having a width of about 1 cm and a hook pitch of about 1 mm×1 mm (i.e., a hook density of 100/cm$^2$). Various presently preferred embodiments encompass strip widths of about 0.25" to about 0.75" and hook densities exceeding 350 hooks per square inch.

Figure 4:
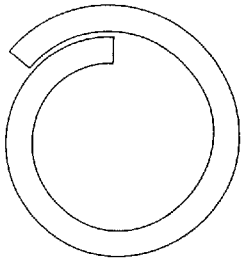
FIG. 4 is a view looking down the cylindrical form of the adjustable diameter hair curler according to a presently preferred embodiment of the present invention.
Figure 5:
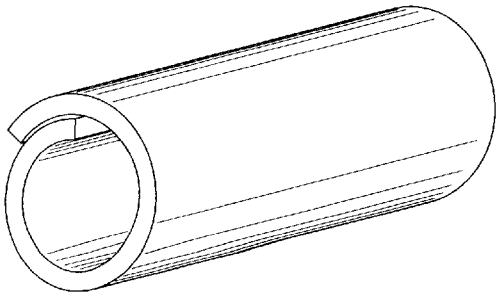
FIG. 5 is a perspective view of the cylindrical form of the adjustable diameter hair curler according to a presently preferred embodiment of the present invention.

According to the present invention the diameter of the curler may be set by manipulating the substrate 12 in a single hand to form a cylindrical shape with the hook-type fasteners of first side center strip 28 on the outside of the cylinder as shown in FIGS. 4 and 5. While a second hand may also be used, a major advantage of this invention is the ability to set the curler diameter with one hand, using the other hand to secure or hold something else. In this manner, speed of use is enhanced as well as providing enhanced ease of using the curlers.

In accordance with another presently preferred embodiment of the present invention, the second side 24 may have indications such as printed lines or other optical markings or tactile indications for various diameter settings, e.g., 1", 2", 3", etc. By aligning a selected portion of the hair curler with such indications, the hair curler would, when curled into a cylindrical form, have the desired diameter. Such lines are illustrated, for example, at FIG. 1B elements 48, 50 and 52.

Figure 6:
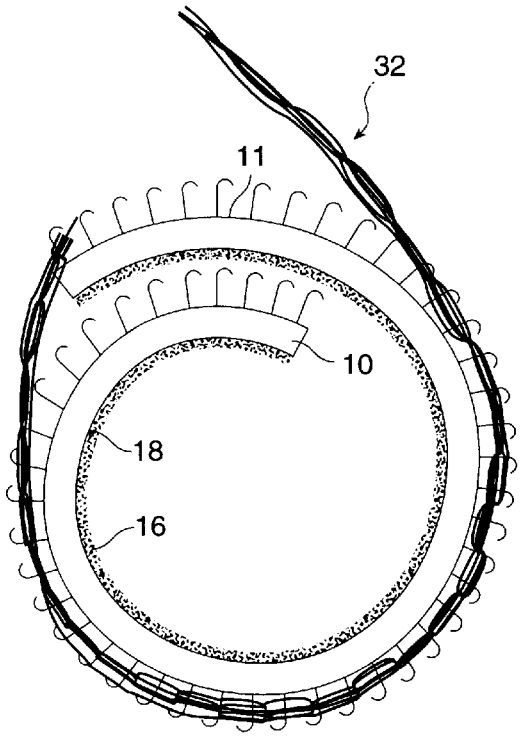
FIG. 6 is a side view of the cylindrical form of the adjustable diameter hair curler according to a presently preferred embodiment of the present invention showing hair wrapped around it as it would be in use.

Once the curler diameter is set, hair 32 may be rolled about the curler as shown in FIG. 6. Conventional bobby pins, hair clips and the like may be used to further attach hair to the curler, as desired. When done, the curlers may be disassembled to their flat states and stored in a very small volume.

Figure 7:
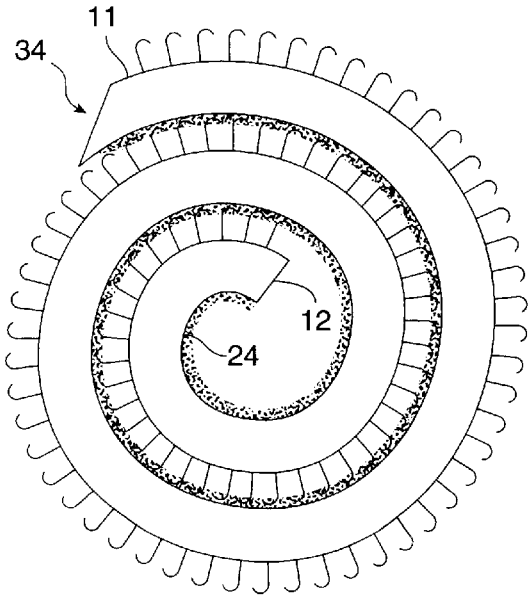
FIG. 7 is a side view of the cylindrical form of the adjustable diameter hair curler according to another preferred embodiment of the present invention showing hair wrapped around it as it would be in use and including a tapered portion.

Referring now to FIG. 7, in another preferred embodiment of the present invention, first side 11 may be tapered to meet or approach second side 24 as shown at taper 34. In this way, bumps or discontinuities due to the overlap of substrate 12 with itself at the outermost edge will be minimized and not imprinted on the hair 32 (FIG. 6).

Figure 8:
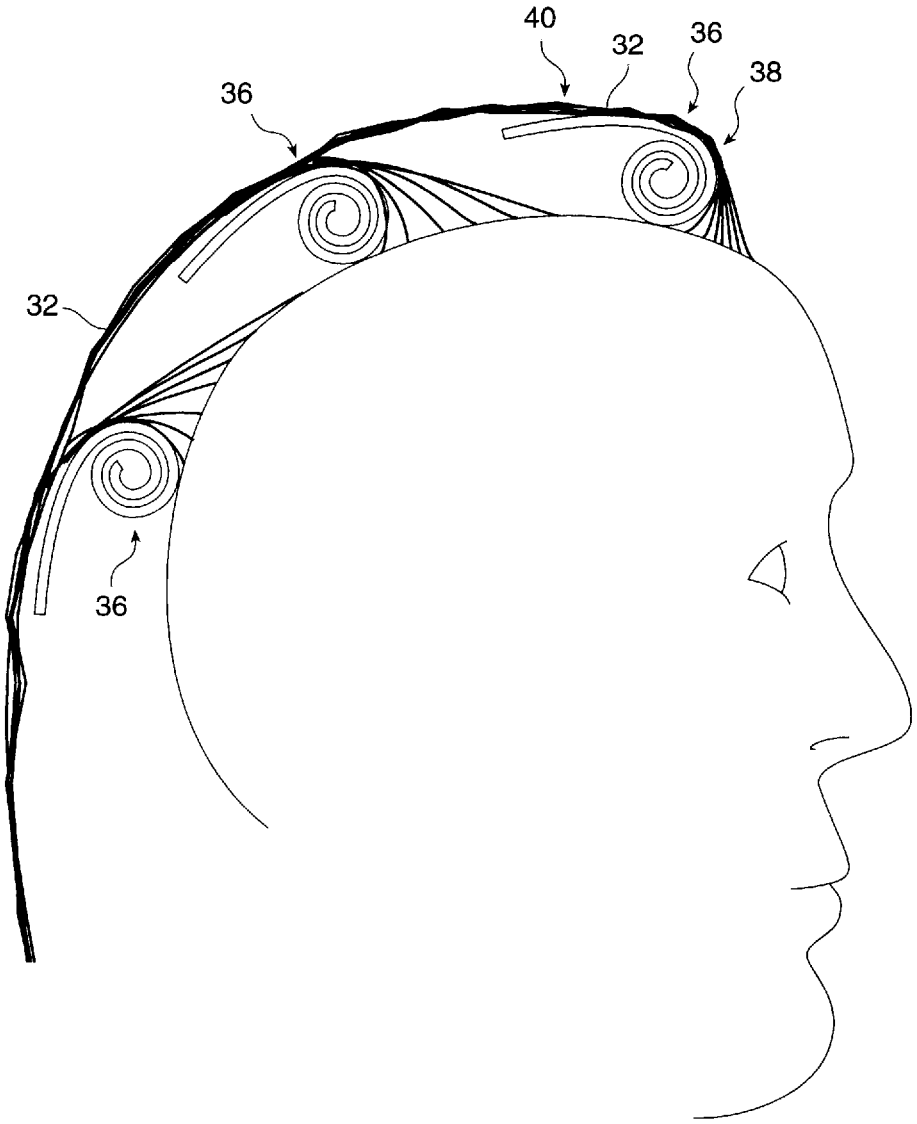
FIG. 8 is a view showing an alternative method of use of the adjustable diameter hair curler according to another preferred embodiment of the present invention showing hair pulled up by the curler and draped over a tail portion of the curler.

Turning now to FIG. 8, the present invention may be used in a novel way to achieve a novel effect. The adjustable curlers 36 may be configured as shown in FIG. 8 so that they comprise a rounded portion 38 and a tail 40. This configuration provides for lifting the hair against the roots while the tail keeps the hair straight, resulting in full hair with straight ends. Conventional round curlers curl the entirety of the hair and are not generally used where straight hair is desired.

Figure 9:
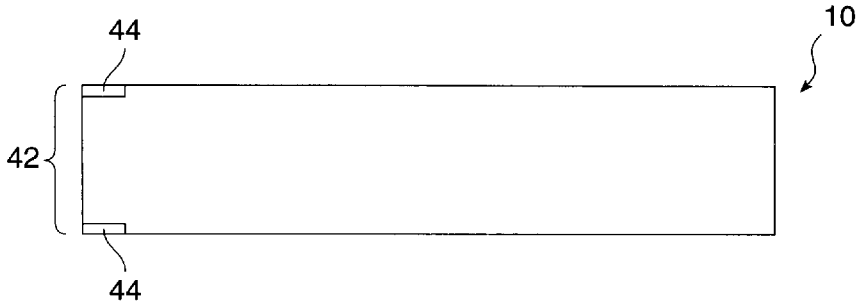
FIG. 9 is a top plan view of an alternative embodiment of the adjustable curler according to the present invention.
Figure 10:
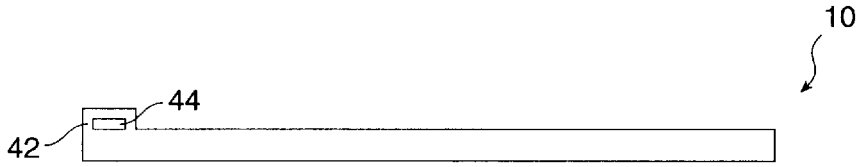
FIG. 10 is a side view of the alternative embodiment of FIG. 9 according to the present invention.
Figure 11:
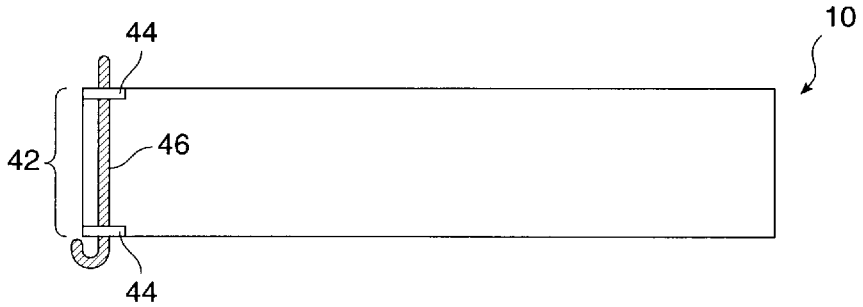
FIG. 11 is a top plan view of the alternative embodiment of FIG. 9 showing a bobby pin in place according to the present invention.

An alternative embodiment of hair curler 10 is shown in FIGS. 9–11. According to this embodiment, a receptacle 42 is provided at one end of hair curler 10 and is preferably formed of a pair of loop-shaped projections 44 which may act to retain and/or guide a pin or clip such as a bobby pin 46 which may be used to hold hair against hair curler 10.

Figure 12:
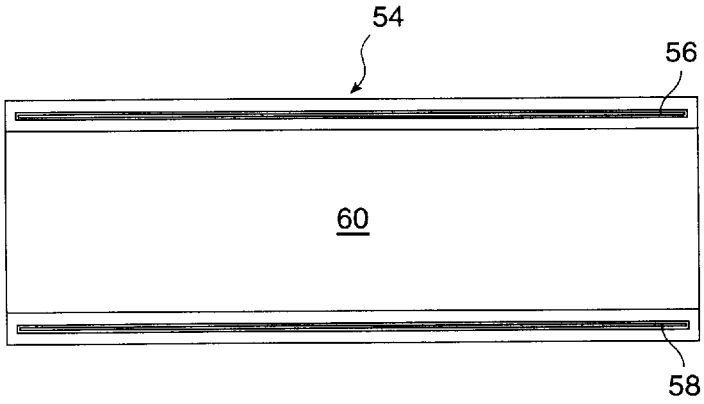
FIGS. 12–14 depict an alternative presently preferred embodiment of the present invention.
Figure 13:
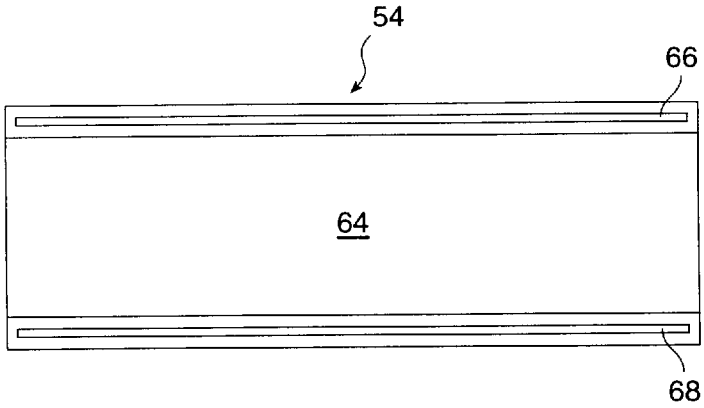
Figure 14:
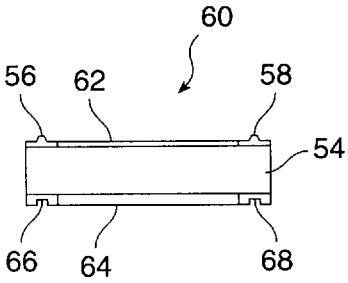
Figure 15:
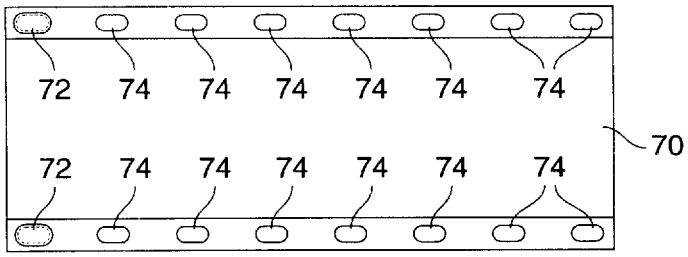
FIGS. 15–17 depict an alternative presently preferred embodiment of the present invention.
Figure 16:
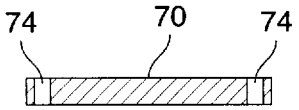
Figure 17:
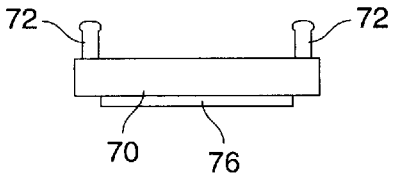

In an alternative embodiment of the present invention, strips 16, 18, 20, 22 may be replaced with another adjustable fastener system such as buttons and holes, snaps and receptacles, pins and holes, ridge and receptacle (like Zip Lok™), and the like. Turning now to FIGS. 12, 13 and 14, FIGS. 12, 13 and 14 depict a hair curler sheet 54 utilizing a "ZipLok™-type" fastening system. A pair of a first type of ZipLok™-type fasteners 56, 58 are disposed on first side 60 of hair curler sheet 54 along with the hook-type elements 62 of the hook and loop fastener system for engaging the hair. On the reverse side 64 of hair curler sheet 54 are disposed a pair of a second type of ZipLok™-type fasteners 66, 68 which are adapted to engage, respectively, fasteners 56 and 58. Those of ordinary skill in the art will readily realize that the fastener types can be mixed and matched so that those on one side of the hair curler sheet will mutually attach and adhere in the conventional manner. Turning now to FIGS. 15, 16 and 17, FIGS. 15, 16 and 17 depict a hair curler sheet 70 using posts 72 and holes 74 to attach the hair curler sheet to itself to fix its diameter. The hook-type elements 76 of the hook and loop fastener system for engaging the hair are disposed on the outside of a cylinder formed by curling the hair curler.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face;

a first strip of loop-type fasteners disposed along said length of said substrate on said first planar face thereof;

a second strip of loop-type fasteners disposed along said length of said substrate on said first planar face thereof;

a third strip of hook-type fasteners disposed along said length of said substrate on said second planar face thereof so as to engage said first strip when said substrate if rolled into a cylinder; and a fourth strip of hook-type fasteners disposed along said length of said substrate on said second planar face thereof so as to engage said second strip when said substrate is rolled into a cylinder.

2. An adjustable diameter hair curler according to claim 1 wherein said substrate includes a lamination comprising a spring steel sheet.

3. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face;

a first strip of loop-type fasteners disposed along said length of said substrate on said first planar face thereof;

a second strip of loop-type fasteners disposed along said length of said substrate on said first planar face thereof;

a third strip of a second type of hook-type fasteners disposed along said length of said substrate on said second planar face thereof so as to engage said first strip when said substrate if rolled into a cylinder; and a fourth strip of a second type of hook-type fasteners disposed along said length of said substrate on said second planar face thereof so as to engage said second strip when said substrate is rolled into a cylinder.

4. An adjustable diameter hair curler according to claim 3 wherein said substrate includes a lamination comprising a spring steel sheet.

5. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face, said first type of hook-type fasteners having a hook density of less than or equal to about 350 hooks per square inch;

a first strip of loop-type fasteners disposed along said length of said substrate on said first planar face thereof;

a second strip of loop-type fasteners disposed along said length of said substrate on said first planar face thereof;

a third strip of a second type of hook-type fasteners disposed along said length of said substrate on said second planar face thereof so as to engage said first strip when said substrate if rolled into a cylinder, said second type of hook-type fasteners having a hook density of more than about 350 hooks per square inch; and a fourth strip of hook-type fasteners disposed along said length of said substrate on said second planar face thereof so as to engage said second strip when said substrate is rolled into a cylinder.

6. An adjustable diameter hair curler according to claim 5 wherein said substrate includes a lamination comprising a spring steel sheet.

7. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face; and securing means disposed along said length of said substrate on said first planar face thereof and said second planar face thereof, said securing means including a first strip and a second strip, said first strip disposed on said first planar face and said second strip disposed on said second face, said first strip and said second strip engageable with one another so as to secure said first strip to said second strip at a selectable location along said length.

8. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face;

first securing means disposed along said length of said substrate on said first planar face thereof and said second planar face thereof, said first securing means including a first strip and a second strip, said first strip disposed on said first planar face and said second strip disposed on said second face, said first strip and said second strip engageable with one another so as to secure said first strip to said second strip at a selectable location along said length; and second securing means disposed along said length of said substrate on said first planar face thereof and said second planar face thereof at locations different from said first securing means, said second securing means including a first strip and a second strip, said first strip disposed on said first planar face and said second strip disposed on said second face, said first strip and said second strip engageable with one another so as to secure said first strip to said second strip at a selectable location along said length.

9. An adjustable diameter hair curler comprising:

a flexible resilient substrate having a first planar face and a second planar face opposite said first planar face, a length of said substrate being longer than a width of said substrate;

an array of a first type of hook-type fasteners disposed over a majority of said first planar face;

a first strip of hook-type fasteners of a second type disposed along said length of said substrate on said first planar face thereof;

a second strip of hook-type fasteners of a second type disposed along said length of said substrate on said first planar face thereof;

a third strip of loop-type fasteners disposed along said length of said substrate on said second planar face thereof so as to engage said first strip when said substrate if rolled into a cylinder; and a fourth strip of loop-type fasteners disposed along said length of said substrate on said second planar face thereof so as to engage said second strip when said substrate is rolled into a cylinder.

10. An adjustable diameter hair curler according to claim 9 wherein said hook-type fasteners of said first type have a lower hook density than said hook-type fasteners of said second type.

11. An adjustable diameter hair curler according to claim 7 wherein said second planar surface includes marks indicating locations to secure said second strip to said first strip to obtain a hair curler of a particular diameter.

12. An adjustable diameter hair curler according to claim 7 wherein said first planar surface includes a smooth tab at one width edge lacking any hook-type fasteners of said first type along said width at said edge.

* * * * *